United States Patent [19]

Samoilov

[11] 4,102,478

[45] Jul. 25, 1978

[54] NEEDLE THREADER

[76] Inventor: Constantin Samoilov, 237 N. Front St., Woodburn, Oreg. 97071

[21] Appl. No.: 754,832

[22] Filed: Dec. 27, 1976

[51] Int. Cl.[2] ..... D05B 87/02

[52] U.S. Cl. ..... 223/99

[58] Field of Search ..... 223/99, 106, 107, 108, 223/109; 112/225; 128/340

[56] References Cited

U.S. PATENT DOCUMENTS

| | | | |
|---|---|---|---|
| 1,144,504 | 6/1915 | Schneider | 223/99 |
| 2,416,260 | 2/1947 | Karle | 223/99 X |
| 2,544,063 | 3/1951 | Biederman | 223/99 |
| 3,404,707 | 10/1968 | Feld | 223/99 X |

FOREIGN PATENT DOCUMENTS

| | | | |
|---|---|---|---|
| 828,829 | 2/1938 | France | 223/99 |
| 386,973 | 12/1923 | Fed. Rep. of Germany | 223/99 |
| 68,963 | 7/1914 | Switzerland | 223/99 |
| 13,363 | 7/1889 | United Kingdom | 223/99 |
| 344,145 | 3/1931 | United Kingdom | 223/99 |

*Primary Examiner*—George H. Krizmanich
*Attorney, Agent, or Firm*—Klarquist, Sparkman, Campbell, Leigh, Hall & Whinston

[57] ABSTRACT

An improved needle-threading device is disclosed wherein a wire loop, having a smaller loop disposed in the medial portion, is rigidly sandwiched at double hook-shaped end portions between an outer support member and an inner support member. The outer and inner support members are tubular with the inner member fitting within the outer member and engaging the double hook-shaped end portions of the wire loop, thereby holding the wire loop rigidly in place and furnishing a convenient handle with which to hold the needle-threading apparatus during use.

6 Claims, 4 Drawing Figures

17
20
17a
20
21
15
23
30

17
17a
16
15
5
9
10
12
25
7

10
25
3
4
12
9
4
5
13
8
15
30
36
35
17
17a
16
16
15

20
15
3
5
6
7
25
9
25
10
12
13
8
25

NEEDLE THREADER

BACKGROUND OF THE INVENTION

1. Field of the Invention

The present invention relates to a needle-threading device.

2. Description of the Prior Art

In the past, needle-threading devices have consisted of a loop of thin wire bent in such fashion as to enable the loop to pass in one direction through the eye of a needle, or through the central bore of a hollow needle, engage a strand of thread, and pull the thread through the eye or bore in the opposite direction. Known needle threaders have encountered problems with the thread disengaging from the wire loop during the thread-pulling operation, thus frustrating the purpose of threading the needle. Also, difficulties have been encountered in attaching the wire loop rigidly and securely to a convenient handle. In known needle threaders, the wire loops have been bonded or otherwise held in place in a handle by various means, most of which are somewhat costly and do not always secure the loop to the handle permanently and so that no play develops between the two parts.

In addition, known needle threaders do not provide for replacement of the wire loop portion if it should break or be damaged, or if, for other reasons, it should be desired to exchange one wire loop for another.

SUMMARY OF THE INVENTION

Principal objects of the present invention are therefore to provide an improved needle-threading device for securely holding thread in the wire loop portion during the threading operation and to rigidly secure the wire threading loop to a convenient handle.

Another more specific object is to provide cooperative inner and outer support members constituting a handle, and designed in such a fashion as to fit inside one another, sandwiching the ends of the wire loop between them, thereby holding the loop ends rigidly in place.

A further object is to provide a simplified, foolproof means for securing the wire loop to the handle of the threader and for replacing the wire loop when desired.

The above objects are carried out in a preferred embodiment by providing the threader with a handle portion composed of an outer tubular support member and an inner tubular support member sized to be slidably received within the outer support member. The outer support member has a closed end and a small opening at such end through which a wire threading loop can pass. A raised collar surrounds such opening, and the innermost end of the support member fits concentrically about such collar and tightly between such collar and the bore wall of the outer support member. The wire loop has reversely curved, generally S-shaped, hooked opposite ends which hook over the collar and become sandwiched tightly between the interengaged surfaces of the inner and outer support members within the bore of the outer support member. The wire loop has a small, tight, thread-holding tip loop at a medial portion defining an outer tip of the wire loop.

The foregoing and other objects, features and advantages will become more apparent in the following detailed description which proceeds with reference to the accompanying drawings.

DETAILED DESCRIPTION OF PREFERRED EMBODIMENT

Figures 1, 2, 3, 4:
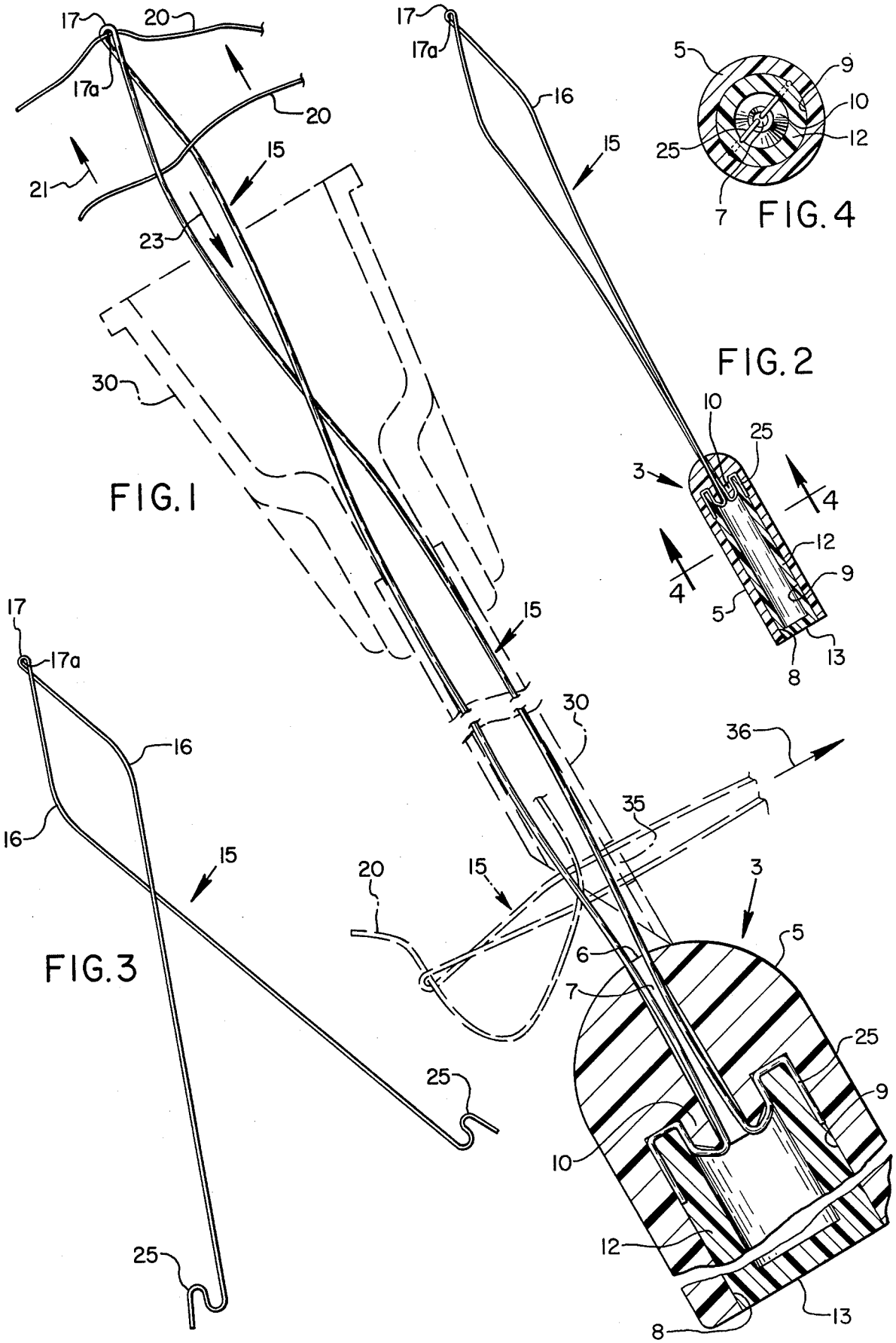
FIG. 1 is an enlarged foreshortened view of a needle threader of the invention with a handle portion thereof shown in longitudinal section and illustrating its use in threading a needle, shown in phantom.
FIG. 2 is a view of the threader of FIG. 1 with the handle portion again being shown in longitudinal section.
FIG. 3 is a view of the wire loop portion of the threader of FIGS. 1 and 2 detached from its handle portion.
FIG. 4 is a transverse section on an enlarged scale, taken along the line 4—4 of FIG. 2.

With reference to the drawing, the improved needle-threading device of the invention includes a handle portion 3 securing the free ends of a wire threading loop portion 15, which is bowed at side portions 16 as shown in FIGS. 2 and 3. The handle portion includes an outer support member 5 of tubular shape and having a small end opening 6 and tapered passage 7, a large end opening 8 and a bore 9 running from the large end opening to a closed end of such member. The tapered passage 7 extends through the closed end. A raised, sharply ridged collar portion 10 concentrically surrounds the inner end of the passage and is spaced inwardly of the wall of bore 9 as shown in FIGS. 1 and 4. Disposed axially within the outer support member is an inner support member 12, itself of tubular shape and closed at one end 13. Such inner member is sized so as to fit snugly within bore 9 with its open end portion concentrically and snugly surrounding raised collar portion 10.

The wire threading loop 15 includes a tip section 17 formed by a small, tight, thread-holding loop 17a midway along the length of the wire loop. The tight tip loop is capable of gripping a thread 20 snugly as the thread is drawn through the bore of an embroidery needle 30 by the threader as shown in FIG. 1.

The opposite end portions 25 of wire loop 15 are bent into reversely curved generally S-shaped hooks. A portion of wire loop 15 adjacent to its hooked ends 25 lies within the small end passage of outer support member 5 of the handle. Hooked ends 25 are disposed within bore 9 of such support member. Such hooked ends hook over and engage raised collar portion 10, and then extend along the bottom and up along the sidewall of bore 9 as best shown by FIG. 1. With the inner support member 12 inserted within bore 9 of the outer support member, the hooked ends 25 of wire loop 15 become tightly sandwiched between the interengaging surfaces of the two support members, including the raised collar portion 10, securing the wire loop rigidly in place within the handle by friction.

The support members are preferably made of a synthetic plastic material of lesser hardness than the wire so that the hooked ends actually become embedded in the plastic of such support members.

The threader is assembled by passing wire loop 15, tip section 17 first, through the tapered passage 7 of outer support member 5 from its bore 9 until the hooked ends 25 of the wire hook onto the raised collar portion 10. Passage 7 is tapered inwardly from its inner, bore end to facilitate passage of the loop therethrough in this manner. The inner support member is then inserted, open end first, into the outer support member, ramming portions of the hooked wire ends 25 against the bottom and sides of bore 9 and against collar 10, sandwiching the wire ends in place. In effect, the hooked wire ends hook about both the inner end of the inner support member and the sharply ridged collar, providing a double bight which resists any attempt to withdraw the wire loop from the handle and prevents any play between the wire loop and handle.

The operation of the needle threader to thread an embroidery needle 30 is best shown with reference to FIG. 1. Wire loop 15, as shown by solid lines, is passed tip first through the central bore of embroidery needle 30. The thread 20, shown by solid lines, is passed through the wire loop and pulled in the direction of arrows 21, thereby becoming engaged in the tight tip loop 17. The wire loop of the threader is then pulled back through the bore of needle 30 in the direction of arrow 23, thereby threading the thread through such bore so that one end of the thread projects out the pointed end of the needle. The thread is then disengaged from the tight tip loop of the wire loop. Thereafter, wire loop 15, as shown by dashed lines, is passed through needle eye 35; the outwardly projecting end of thread 20, shown by dashed lines, is engaged in the tip loop as before, and the wire loop is pulled back through the eye 35 in the direction of arrow 36, pulling the thread with it. The needle is now threaded and ready for use.

It is to be understood that the threader described may also be used to thread needles of types other than that shown in FIG. 1, needle 30 being shown for illustrative purposes only.

Having illustrated and described the principles of my invention by what is presently a preferred embodiment, it should be apparent to those persons skilled in the art that such embodiment may be modified in arrangement and detail without departing from such principles. I claim as my invention all such modifications as come within the true spirit and scope of the following claims.

I claim:

1. In a needle threader:

a handle portion comprising:

a first support member comprising an outer support member of tubular shape, a second support member for cooperative interengagement with said first support member, said members having mutually interengaging surfaces, said second support member comprising an inner support member snugly disposed within said outer support member, a wire threading loop having at one end two terminal wire ends and at the opposite end, medially of said wire ends, a thread-engaging tip portion, said wire ends being tightly sandwiched between said interengaging surfaces of said inner and outer support members so as to be held rigidly in place thereby, said outer support member including a hollow axial bore for slidably receiving said inner support member and extending from an open end of said outer support member to a closed end thereof, means defining a wire passage extending axially through said closed end and opening into said bore for receiving a portion of said wire threading loop, and a raised collar portion extending inwardly of said bore from said closed end, said collar portion surrounding the opening of said wire passage into said bore and being spaced from the sidewalls of said bore so as to fit snugly within a portion of said inner support member.

2. A device according to claim 1 wherein said raised collar portion is sharply ridged.

3. A device according to claim 1 wherein said wire ends are reversely curved and generally S-shaped so as to hook over and engage said raised collar portion and become sandwiched between mutually interengaged surfaces of said collar portion, said inner support member and the sidewalls of said bore when said inner support member is disposed fully within said outer support member.

4. A device according to claim 3 wherein said wire threading loop includes a small, tight tip loop, disposed medially between its terminal ends for gripping thread.

5. A device according to claim 2 wherein said wire ends define reversely curved and generally S-shaped hooked ends that hook over and engage said sharply ridged collar portion and become tightly sandwiched between mutually interengaged surfaces of said collar portion, said inner support member and the sidewalls of said bore when said inner support member is disposed fully within said outer support member.

6. A device according to claim 5 wherein said wire threading loop includes a small, tight tip loop disposed medially between its terminal ends for gripping thread.

* * * * *